US008631863B2

(12) United States Patent
Heckel et al.

(10) Patent No.: US 8,631,863 B2
(45) **Date of Patent: *Jan. 21, 2014**

(54) SNAP MOUNT ANNULAR DEBRIS BARRIER

(75) Inventors: Donald T. Heckel, Montgomery, TX (US); James R. Zachman, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 202 days.

This patent is subject to a terminal disclaimer.

(21) Appl. No.: 13/204,287

(22) Filed: Aug. 5, 2011

(65) Prior Publication Data

US 2013/0032330 A1 Feb. 7, 2013

(51) Int. Cl.
*E21B 43/00* (2006.01)
*E21B 17/00* (2006.01)

(52) U.S. Cl.
USPC ..... 166/236; 166/229; 166/242.6

(58) Field of Classification Search
USPC ..... 166/229, 236, 242.6; 210/170.01, 459; 403/288, 365, 372; 285/322, 319, 305, 285/921
See application file for complete search history.

(56) References Cited

U.S. PATENT DOCUMENTS

| | | | | |
|---|---|---|---|---|
| 4,548,265 | A * | 10/1985 | Luke | 166/140 |
| 5,582,253 | A | 12/1996 | Fraser | |
| 6,041,855 | A * | 3/2000 | Nistor | 166/50 |
| 6,302,217 | B1 | 10/2001 | Kilgore et al. | |
| 6,308,782 | B1 * | 10/2001 | Brooks et al. | 166/313 |
| 6,581,667 | B2 | 6/2003 | Waring | |
| 7,032,675 | B2 | 4/2006 | Steele et al. | |
| 7,210,534 | B2 * | 5/2007 | Hayter et | 166/386 |
| 7,472,756 | B2 * | 1/2009 | Wong | 166/386 |
| 7,549,486 | B2 * | 6/2009 | Mashburn et al. | 175/57 |
| 7,798,212 | B2 * | 9/2010 | Bolze et al. | 166/242.6 |
| 2004/0221984 | A1 | 11/2004 | Cram | |
| 2008/0063979 | A1 | 3/2008 | Tomita et al. | |
| 2008/0115929 | A1 | 5/2008 | Kossa et al. | |
| 2009/0090518 | A1 | 4/2009 | Coon et al. | |
| 2009/0283330 | A1 | 11/2009 | Lynde et al. | |
| 2010/0032167 | A1 | 2/2010 | Adam et al. | |
| 2011/0108266 | A1 | 5/2011 | Smith et al. | |
| 2011/0114324 | A1 | 5/2011 | Hayter et al. | |
| 2011/0168385 | A1 | 7/2011 | O'Malley | |

FOREIGN PATENT DOCUMENTS

WO 2008063979 A1 5/2008

OTHER PUBLICATIONS

Greene Tweed, WR 525 product data, 1 pg.

* cited by examiner

*Primary Examiner* — Jennifer H Gay
*Assistant Examiner* — George Gray
(74) *Attorney, Agent, or Firm* — Steve Rosenblatt

(57) ABSTRACT

A debris barrier snap fits to a tubular groove of one of the tubulars that define the annular gap in which the barrier is to be mounted. It is loosely mounted so that it can center itself in the annulus as the relatively moving members go out of a concentric arrangement. The continuous carbon fiber material used for the debris barrier has lubricious qualities to act as a bushing when the annulus shape changes due to movement of the tubulars out of a concentric relationship. An outer or inner groove on the barrier acts to trap and retain small particles that manage to advance between the barrier and the outer tubular. The snap fit is accomplished with flexible spaced apart fingers with grip surfaces to engage a groove on one of the tubulars.

16 Claims, 5 Drawing Sheets

SNAP MOUNT ANNULAR DEBRIS BARRIER

FIELD OF THE INVENTION

The field of the invention is debris barriers for annular gaps that are defined by relatively moving members and more particularly where the debris barrier snap mounts and self centers while acting as a bearing when the members move to possible a non-concentric relationship during relative movement.

BACKGROUND OF THE INVENTION

Debris barriers are used to prevent particulate buildup in confined spaces that could subsequently impede or prevent operation of other equipment or subsequent relative movement between close fitting components that need to move relatively at some later time. Some applications have no relative movement and the debris barrier is there to isolate equipment such as a liner hanger. Once the hanger is set the debris barrier can be pulled out with the running tool that delivered the liner. On example of this type of annular barrier is shown as item 54 in US Publication 2010/0032167. Another is item 7 in US Publication 20110108266.

Debris barriers can also be placed on whipstocks to keep the whipstock anchor below free of debris as illustrated in U.S. Pat. No. 6,308,782. Debris barriers can be associated with slips so that slip extension energizes a debris barrier such as 34, 164 in U.S. Pat. No. 6,302,217. Annular barriers can be retracted during run in and extended at a desired location with axial compression as with barrier 30 in WO 2008/063979. Debris barriers can be inflatable structures such as item 92 in US Publication 2009/0283330. Debris barriers can temporarily block a tubular string as in item 150 in US Publication 2009/0090518. Applications using sliding sleeves employ debris barriers such as 30b in U.S. Pat. No. 7,032,675. Seals for sliding sleeves are also made from packing material made of continuous carbon fiber in item 30a in the latter patent. On a larger scale such as in a boiler application there are debris barriers internal to the boiler as in item 10 of U.S. Pat. No. 6,581,667.

One such valve that has relatively moving exposed parts to wellbore debris is the RB Isolation Valve offered by Baker Hughes Incorporated, components for which are shown in U.S. Pat. No. 7,210,534 and US Publication 2011/0114324.

What is needed and provided by the present invention is a debris barrier that can exclude most solids from an annular space defined by relatively moving components that might not maintain concentricity during relative movement. The barrier is preferably snap fit and sufficiently loosely mounted so as to enable it to shift and center itself as the shape of the annular space that it blocks changes. It is preferably made of continuous carbon fiber so that it has similar expansion properties as the tubulars that define the annular space where the barrier is mounted. It functions as a bushing using its lubricious properties should the shape of the annular space change due to the tubulars moving out of a concentric relationship. The barrier has an external groove to retain some of the small particles that get between the barrier and the outer tubular that defines the annular space. The part can be made using tight tolerances to maintain very small clearances upon assembly, which is helpful for the exclusion of the solids. The groove can be internal.

Those skilled in the art will have a greater understanding of the invention from a review of the description of the preferred embodiment and the associated drawings while recognizing that the full scope of the invention is determined from the appended claims.

SUMMARY OF THE INVENTION

A debris barrier snap fits to a tubular groove of one of the tubulars that define the annular gap in which the barrier is to be mounted. It is loosely mounted so that it can center itself in the annulus as the relatively moving members go out of a concentric arrangement. The continuous carbon fiber material used for the debris barrier has lubricious qualities to act as a bushing when the annulus shape changes due to movement of the tubulars out of a concentric relationship. An outer groove on the barrier acts to trap and retain small particles that manage to advance between the barrier and the outer tubular. The snap fit is accomplished with flexible spaced apart fingers with grip surfaces to engage a groove on one of the tubulars.

DETAILED DESCRIPTION OF THE PREFERRED EMBODIMENT

Figure 1:
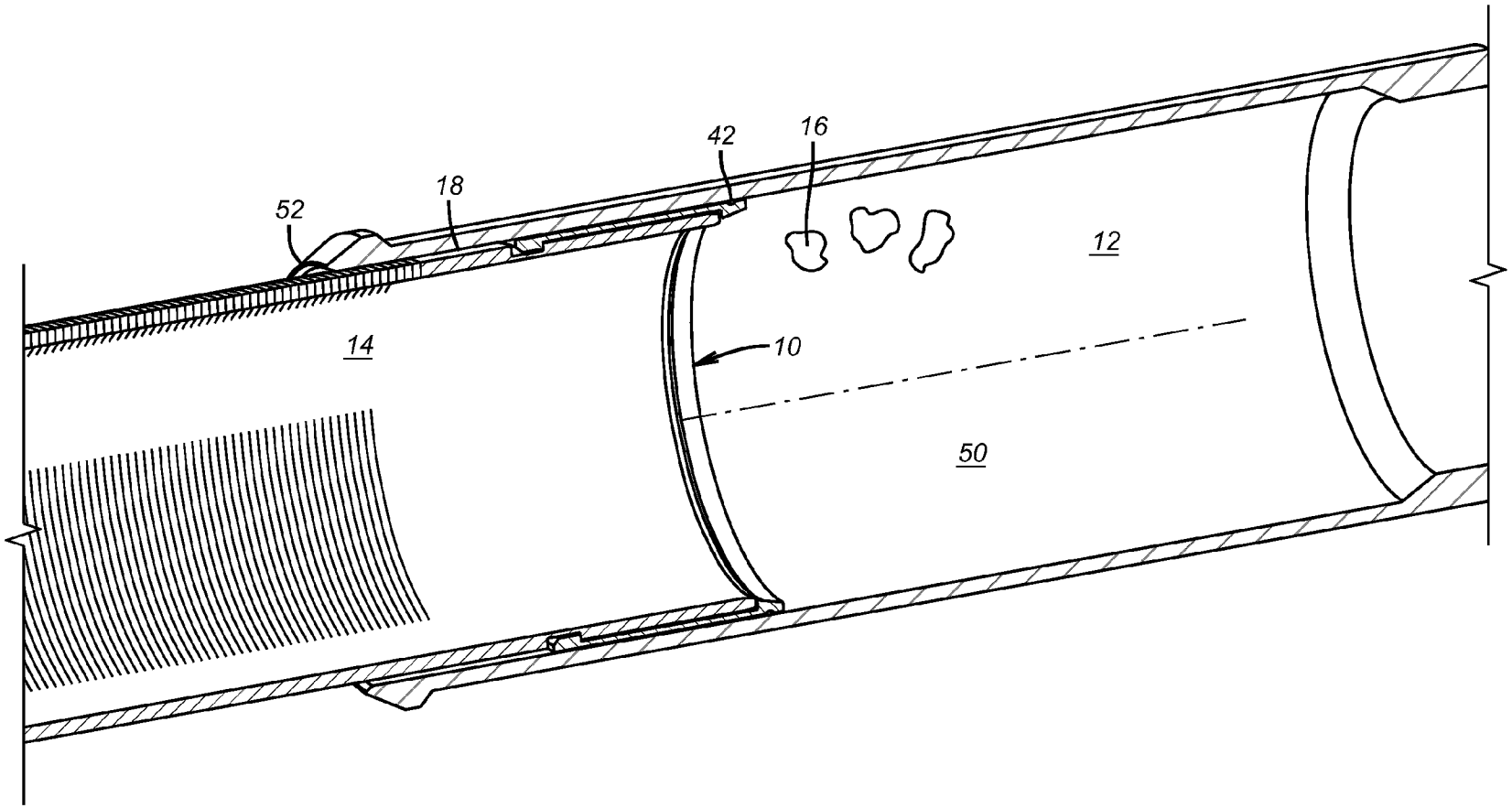
FIG. 1 is a perspective view of the debris barrier assembled between two tubulars.

FIG. 1 shows the debris barrier 10 between relatively movable tubulars 12 and 14. Debris 16 is schematically illustrated within tubulars 12 and 14. Should the debris 16 enter the interface 18 between tubulars 12 and 14 their ability to move relatively could be impeded and the tool with which such components are associated would cease to function. Debris could also enter into other places in the tool which could impede the operation of the tool. The FIGS. are intended to be generic as the debris barrier of the present invention can be used in a variety of applications although the preferred embodiment is in the RB Isolation Valve sold by Baker Hughes Incorporated.

Figure 2:
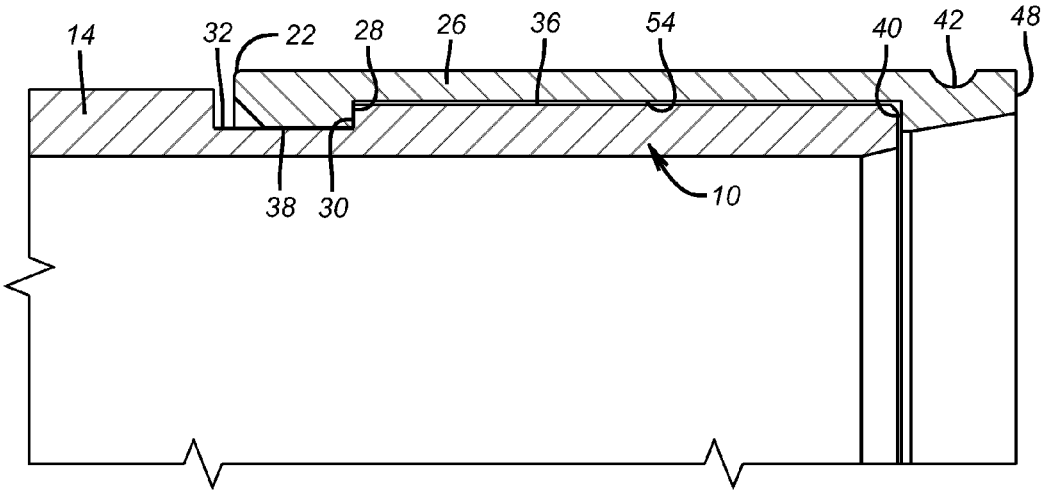
FIG. 2 is a section view showing how the debris barrier is mounted to a tubular.
Figure 4:
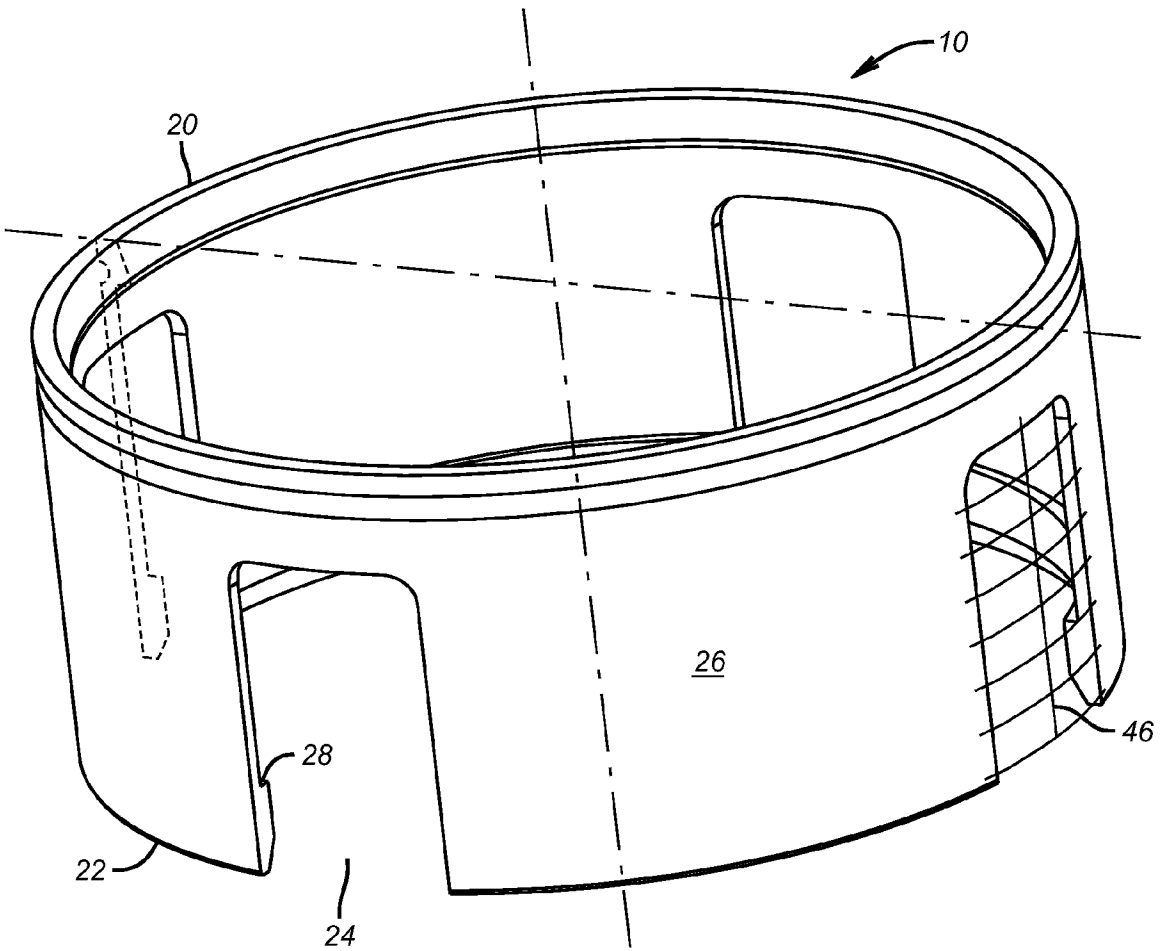
FIG. 4 is a perspective of the debris barrier by itself.
Figure 5:
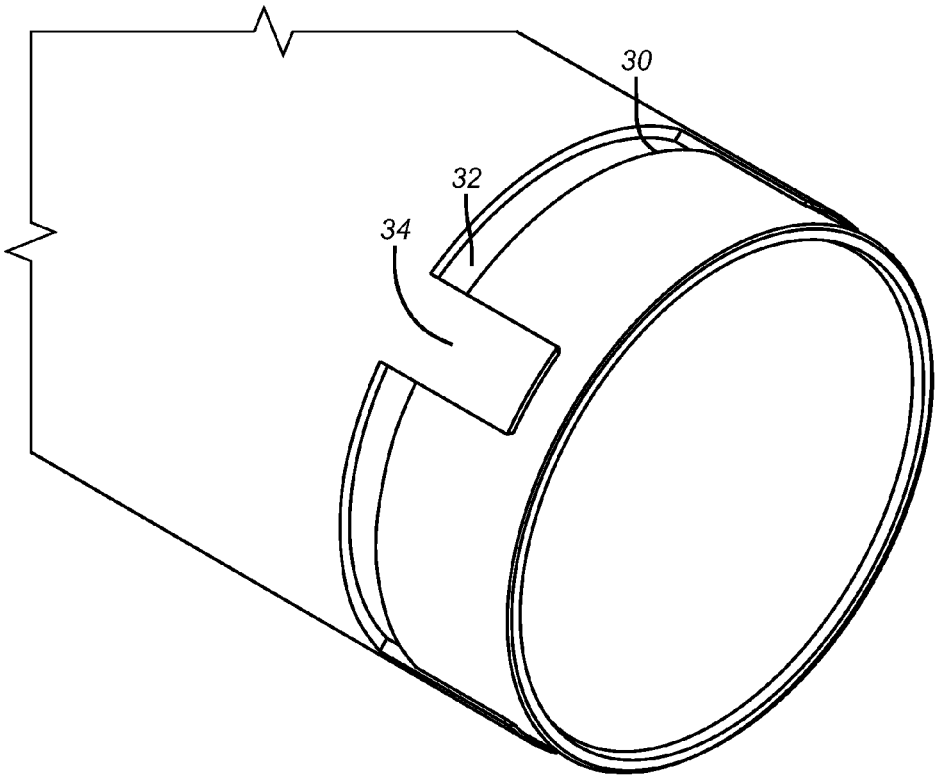
FIG. 5 is a perspective view of the tubular onto which the debris barrier will be mounted.
Figure 6:
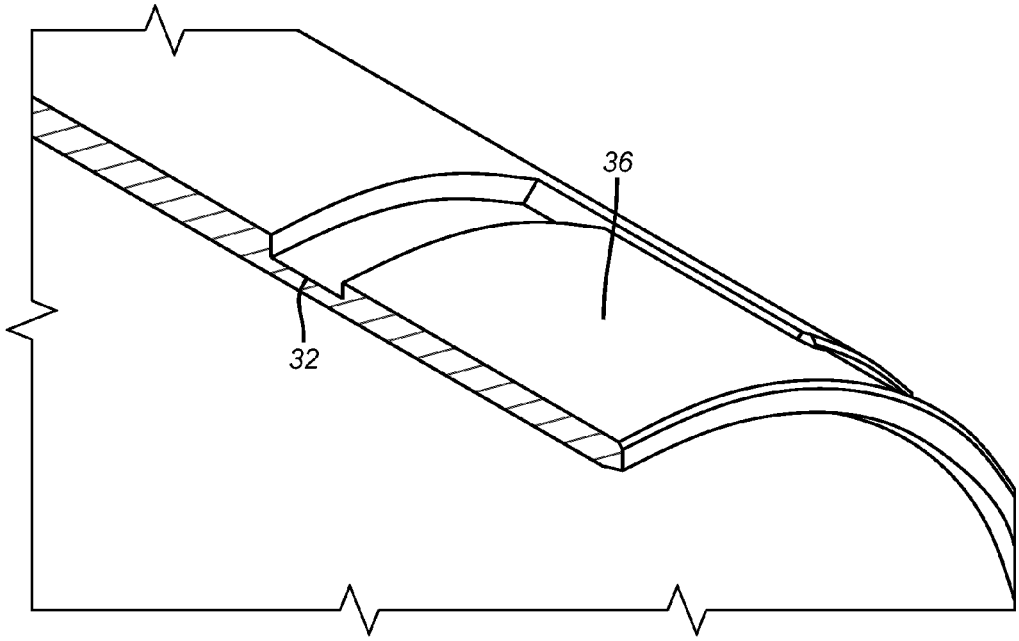
FIG. 6 is a part section view of the view of FIG. 5.

As shown in FIG. 4 the debris barrier is a ring structure having a fully circular end 20 and an opposed end 22 that has gaps 24. A series of spaced fingers 26 extend from end 20 and define the gaps 24 among them. Although four fingers at 90 degree spacing are shown, greater or lesser amounts of fingers can be used and at different spacing than illustrated. The illustrated fingers each have a gripping surface 28 which can be a radial surface. FIG. 2 illustrates the attachment of the barrier 10 to the tubular 14 is accomplished by moving the barrier 10 over the tubular 14 so that the fingers 26 straddle projections 34 until the end 22 has advanced enough so that gripping surface 28 clears surface 30 and the end 22 snaps into groove 32. When that happens, the fingers 26 straddle the projections 34 to optionally limit relative rotation between the barrier 10 and the tubular 14 that supports it. Projections 34 strengthen the structure of the tubular 14. While interaction with one groove 32 is shown, multiple surfaces 28 can snap into multiple grooves 32 as contemplated by the present invention.

Figure 3:
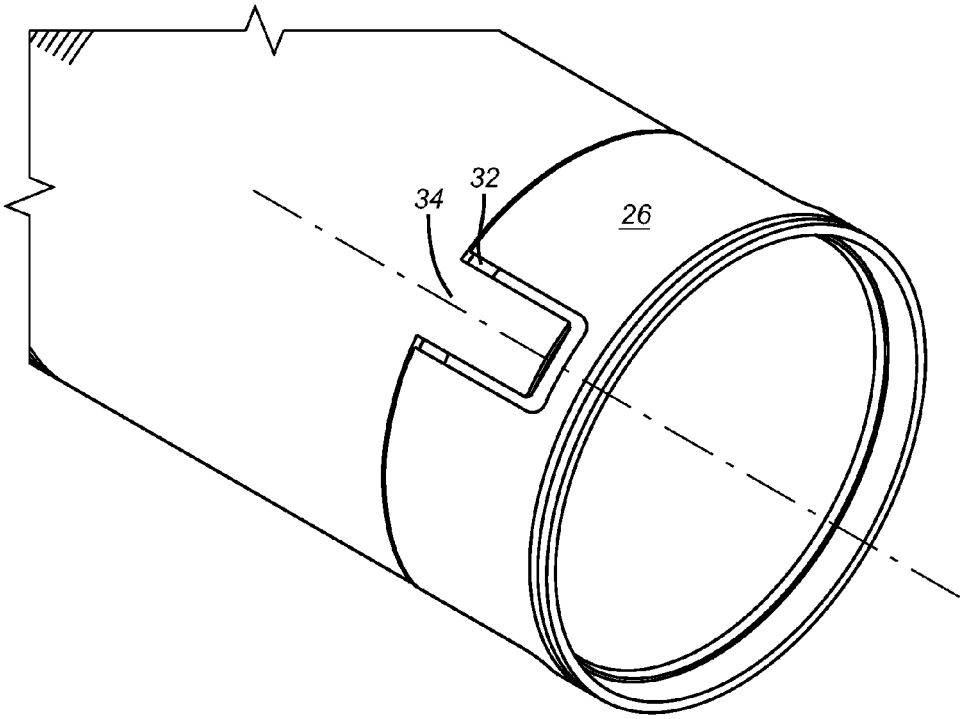
FIG. 3 is a perspective view of the debris barrier in FIG. 2.

As seen in FIGS. 2 and 3 the surface 38 on fingers 26 is outwardly deflected during sliding over surface 36 of the tubular 14 until such time as surface 28 clears surface 30 so that the fingers 26 can spring toward groove 32 near their lower end 22. After the springing action into groove 32 it is preferred that there is still a loose fit between the barrier 10 and the tubular 14 caused by the spacing between surfaces 28 and 40 being somewhat longer than the distance between surface 30 and top end 40. The loose fit is preferred to allow for assembly through a full tolerance range and so that there is some accommodation for movement of tubulars 12 and 14 in a manner where they are not concentric. A loose fit is also preferred between surfaces 36 and 54. Too tight a fit could get the tubulars 12 and 14 into a bind. Minimizing the binding tendency of the relatively movable tubulars is also the preferred material for the barrier 10 being continuous carbon fiber. The lubricious properties of continuous carbon fiber promotes the relative sliding motion or other motion that may occur between tubular 12 and debris barrier 10. Barrier 10 is allowed to align itself to accommodate such motion aided by the preferred loose fit upon assembly as shown in the FIG. 1 view. The low coefficient of thermal expansion also promotes the relative movement needs of tubulars 12 and 14 with very small amounts of space available in a heated environment.

Groove 42 located on the exterior of the barrier 10 and near end 20 works as a capture location for small debris that gets past end 20 to get the debris out of the way so that relative sliding motion of the tubulars 12 and 14 can continue despite some infiltration of solids into the annular space between barrier 10 and the surrounding tubular 12 and to prevent debris from getting further into the internal workings of the tool. Groove 42 can be an interior groove.

Figure 7:
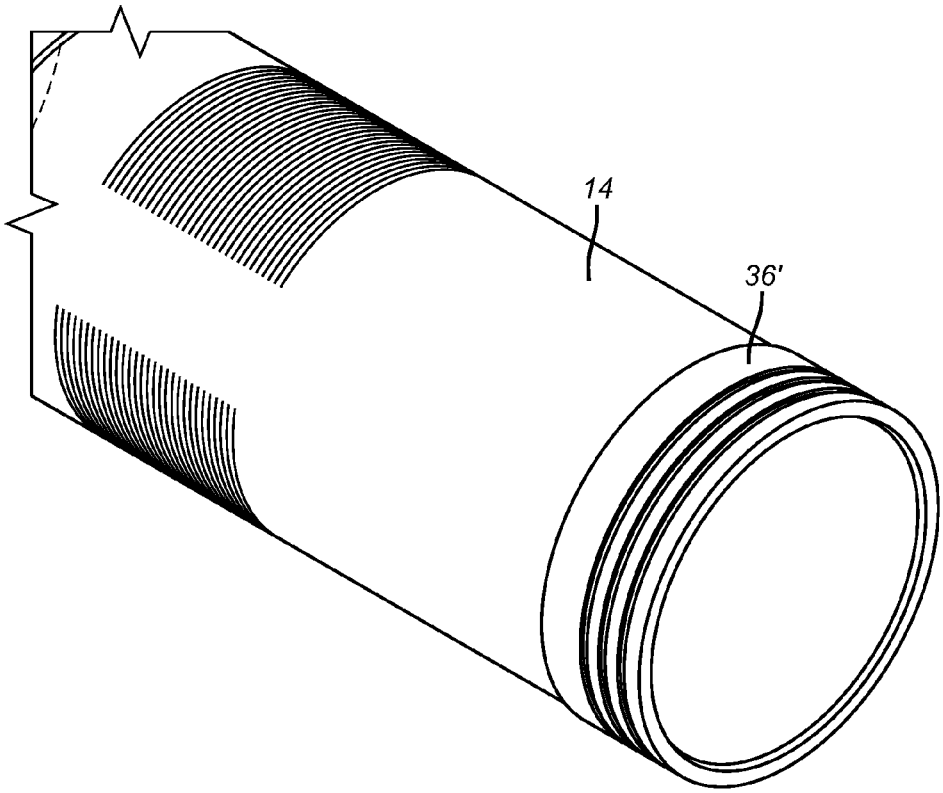
FIG. 7 is an alternative embodiment of the tubular onto which the debris barrier will be mounted.
Figure 8:
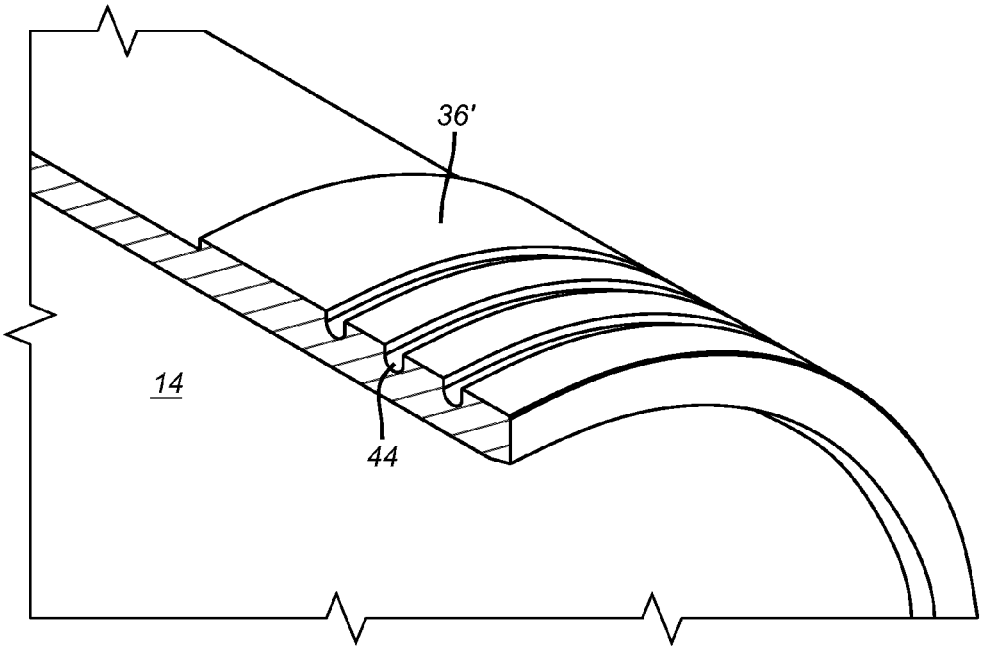
FIG. 8 is a part section view of the view in FIG. 7.

The same concept can also be employed on tubular 14 as shown in FIGS. 7 and 8 in an alternative embodiment. Here the fingers 34 are eliminated so that the barrier 10 can more freely relatively rotate with respect to the tubular 14 to which it is loosely snap fit. Thus surface 36' goes all the way around circumferentially and has one or more grooves 44 to hold any small debris that has migrated between the barrier 10 and the tubular 14. To make the grooves 44 more effective, the barrier 10 can optionally be a cylindrical shape but instead of open gaps between fingers 26 can have thinner wall segments or screen material shown schematically as 46 in FIG. 4 with a mesh fine enough to hold solids in groove or grooves 44.

The small clearance between parts is the primary mode of debris exclusion using the barrier 10.

The objective is to provide sufficient flexibility to allow surface 38 to expand to jump over surface 36 during assembly. A discrete finger structure is not necessary. A cylindrical shape can simply be notched or cut clean through such as with wire EDM to give the resulting cylindrical shape a spring like functionality so that assembly is facilitated. After assembly there would be enough potential energy to keep the surface 28 from moving out radially beyond surface 30 although in the preferred embodiment the presence of tubular 12 over the barrier 10 that had previously been snap fit to tubular 14 should in and of itself be sufficient to keep end 22 in groove 32 while allowing relative movement between tubulars 12 and 14.

The barrier 10 can itself have grooves internally or externally beyond the groove 42 and for the same purpose but a limit exists on the number of grooves that can optionally be used since the structural integrity of the barrier 10 can be affected.

Those skilled in the art will appreciate that the barrier 10 has the beneficial qualities of easy snap in mounting while also having a loose enough fit to self align if the two relatively moving tubulars that define the annular gap in which the barrier 10 is mounted can move to positions where they are not concentric. The barrier 10 serves as a bearing or bushing of sorts taking advantage of the properties of the continuous carbon fiber, which is the preferred material. Other lubricious materials that can withstand the downhole conditions can be used such as Teflon®, for example. A preferred material is continuous carbon fiber in a thermoplastic composite such as PEEK matrix that has excellent non-galling and non-seizing characteristics. The barrier has features that allow some entering debris to be retained in a groove or grooves in the barrier itself where very fine particles can collect. Screens or threads are other alternatives to the groove or grooves. As another option there can be holes in the groove or grooves to allow a washing out of some of the debris so it does not build up in the groove. The use of a finger structure to mesh with projections on the tubular to which the barrier is mounted will also minimize or eliminate relative rotation between the barrier and the tubular that supports it. Rotational locking of the debris barrier 10 is optional. Web sections 34 are there primarily to lend strength to the tubular 14 that has a fairly thin wall thickness.

Although the barrier 10 is shown mounted to tubular 14 where it is exposed to debris in passage 50, the barrier 10 can be secured to tubular 12 at an end 52 and snap connect to tubular 12 in the same manner as described above for tubular 14.

Item 12 slides with respect to item 14 without normal contact. They are not locked to each other.

When mounted, the barrier 10 preferably floats in a tight clearance application and in a confined mounting location. Despite thermal loads the barrier 10 can continue to function by aligning itself while held in place to continue to exclude debris. The above description is illustrative of the preferred embodiment and many modifications may be made by those skilled in the art without departing from the invention whose scope is to be determined from the literal and equivalent scope of the claims below:

We claim:

1. A debris barrier assembly for an annular space for use in a subterranean location, comprising:

nested inner and outer tubulars defining an open to flow annular gap therebetween;

a ring shaped debris barrier disposed in said annular gap to substantially close said annular gap while leaving a path for fluid movement and having a flexible portion comprising a part of a retaining mechanism;

one of said inner and outer tubulars further comprising a remaining part of said retaining mechanism such that moving said barrier onto one of said tubulars loosely retains said barrier to that tubular and in said annular gap.

2. The assembly of claim 1, wherein:

said flexible portion increases in dimension on assembly to one of said tubulars before decreasing in dimension by flexing when aligned with the remaining part of said retaining mechanism on one of said tubular members.

3. The assembly of claim 2, wherein:

said flexible portion comprises a radial surface that flexes into at least one groove on one of said tubulars when aligned therewith for retention of said barrier.

4. The assembly of claim 3, wherein:

said flexible portion comprises a plurality of spaced cantilevered fingers.

5. The assembly of claim 4, wherein:

said spaces between said fingers are spanned by a screen material.

6. The assembly of claim 4, wherein:

said fingers straddle spaced projections on said tubular to which said barrier is fitted such that the tubular is strengthened and, optionally, relative rotation of said barrier when mounted to the tubular is limited.

7. The assembly of claim 6, wherein:

said barrier comprising at least one groove extending at least in part circumferentially on an inner or outer side thereof for retaining debris in said groove.

8. The assembly of claim 1, wherein:

said barrier self aligns upon relative movement between said tubulars that changes a dimension of said annular gap.

9. The assembly of claim 1, wherein:

said barrier acts as a bearing between said tubulars to facilitate their relative movement in the event said tubulars move toward each other to touch.

10. The assembly of claim 9, wherein:

said barrier is made of a lubricious material.

11. The assembly of claim 10, wherein:

said barrier is made of continuous carbon fiber.

12. The assembly of claim 1, wherein:

said flexible portion is formed from reductions in wall thickness of said barrier or removal of portions of the wall of said barrier.

13. The assembly of claim 1, wherein:

said debris barrier can rotate after it is mounted.

14. The assembly of claim 1, wherein:

clearance between said debris barrier and one of said inner and outer tubulars acts to reduce debris infiltration past said barrier.

15. The assembly of claim 14, wherein:

said barrier possessing thermal expansion characteristics that maintain said clearance when exposed to thermal loads from well fluids.

16. The assembly of claim 1, wherein:

said debris barrier comprises at least one groove on at least one of an inner or outer surface thereof, said groove further comprising at least one hole to allow some debris to exit said groove.

* * * * *